US010900459B2

(12) United States Patent
Wakasugi et al.

(10) Patent No.: US 10,900,459 B2
(45) Date of Patent: Jan. 26, 2021

(54) IGNITION CONTROL SYSTEM AND IGNITION CONTROL DEVICE

(71) Applicant: DENSO CORPORATION, Kariya (JP)

(72) Inventors: Ryota Wakasugi, Kariya (JP); Akimitsu Sugiura, Kariya (JP); Fumiaki Aoki, Nisshin (JP)

(73) Assignee: DENSO CORPORATION, Kariya (JP)

( * ) Notice: Subject to any disclaimer, the term of this patent is extended or adjusted under 35 U.S.C. 154(b) by 54 days.

(21) Appl. No.: 16/441,384

(22) Filed: Jun. 14, 2019

(65) Prior Publication Data

US 2019/0293042 A1 Sep. 26, 2019

Related U.S. Application Data

(63) Continuation of application No. PCT/JP2017/042415, filed on Nov. 27, 2017.

(30) Foreign Application Priority Data

Dec. 15, 2016 (JP) ..... 2016-243190

(51) Int. Cl.
*F02P 3/045* (2006.01)
*F02P 9/00* (2006.01)
(Continued)

(52) U.S. Cl.
CPC ..... *F02P 3/045* (2013.01); *F02P 3/0853* (2013.01); *F02P 3/10* (2013.01); *F02P 5/142* (2013.01);
(Continued)

(58) Field of Classification Search
CPC ..... F02P 13/00; F02P 9/00; F02P 3/04; F02P 5/1502; F02P 3/0456; F02P 3/0407;
(Continued)

(56) References Cited

U.S. PATENT DOCUMENTS 2,894,161 A * 7/1959 Sheheen ..... F02P 3/10 313/131 R
3,538,372 A * 11/1970 Terao ..... H01T 13/20 313/131 R
(Continued)

FOREIGN PATENT DOCUMENTS

EP 1202411 A1 * 5/2002 ..... H01T 13/52
JP 61268872 A * 11/1986
(Continued)

*Primary Examiner* — Sizo B Vilakazi
*Assistant Examiner* — Brian R Kirby
(74) *Attorney, Agent, or Firm* — Nixon & Vanderhye P.C.

(57) ABSTRACT

An ignition control system includes a spark plug including a cylindrical ground electrode, a cylindrical insulator having a protruding portion held inside the ground electrode and protruding toward a tip side the spark plug relative to the ground electrode, and a center electrode held inside the insulator and exposed from the insulator, an ignition coil including a primary coil and a secondary coil, and a primary current control unit performing creeping discharge control for generating a creeping discharge along a surface of the insulator, and air discharge transition control for stopping the creeping discharge occurring in the spark plug after the creeping discharge control is performed, and cutting off primary current after a discharge stop period ends, in one combustion cycle of the engine.

12 Claims, 10 Drawing Sheets

(51) Int. Cl.

| | |
|---|---|
| ***F02P 13/00*** | (2006.01) |
| ***H01T 13/52*** | (2006.01) |
| ***F02P 5/14*** | (2006.01) |
| ***F02P 3/08*** | (2006.01) |
| ***F02P 3/10*** | (2006.01) |
| ***F02P 3/04*** | (2006.01) |
| ***F02P 3/05*** | (2006.01) |

(52) U.S. Cl.
CPC ..... *F02P 9/00* (2013.01); *F02P 13/00* (2013.01); *H01T 13/52* (2013.01); *F02P 3/04* (2013.01); *F02P 3/05* (2013.01)

(58) Field of Classification Search
CPC .. F02P 3/045; F02P 3/05; F02P 3/0853; F02P 3/10; F02P 5/14; F02P 5/142; F02P 17/10; F02P 9/007; H01T 13/50; H01T 13/52
USPC ..... 123/608, 644, 620, 625–626; 313/142
See application file for complete search history.

(56) References Cited

U.S. PATENT DOCUMENTS 3,974,412 A * 8/1976 Pratt, Jr. ..... F02P 9/007 313/131 R
4,087,719 A * 5/1978 Pratt, Jr. ..... H01T 13/20 123/169 EL
4,092,558 A * 5/1978 Yamada ..... H01T 13/52 313/131 R
4,219,003 A * 8/1980 Sato ..... F02B 53/12 123/210
4,337,408 A * 6/1982 Sone ..... H01T 13/54 313/130
4,631,451 A * 12/1986 Anderson ..... H01T 13/52 123/620
4,798,991 A * 1/1989 Benedikt ..... H01T 13/52 313/131 R
4,841,925 A * 6/1989 Ward ..... F02P 3/0884 123/143 B
4,870,319 A * 9/1989 Benedikt ..... H01T 13/52 313/137
4,914,344 A * 4/1990 Watanabe ..... H01T 13/467 313/140
5,187,404 A * 2/1993 Straub ..... H01T 13/52 313/130
5,731,654 A * 3/1998 Benedikt ..... H01T 13/52 313/131 A
6,265,814 B1 * 7/2001 Yoshinaga ..... H01T 13/40 313/131 R
7,948,158 B2 * 5/2011 Kato ..... H01T 13/50 313/131 R
8,053,965 B2 * 11/2011 Boehler ..... H01T 13/20 313/141
8,994,256 B2 * 3/2015 Below ..... H01T 13/467 313/141
9,825,431 B2 * 11/2017 Kosuge ..... H01T 13/08
2007/0114898 A1 * 5/2007 Nagasawa ..... H01T 13/50 313/141
2010/0117507 A1 * 5/2010 Suzuki ..... H01T 13/34 313/143
2013/0181629 A1 * 7/2013 Urushihara ..... H05H 1/48 315/223
2015/0008838 A1 * 1/2015 Reuther ..... F02P 15/10 315/209 T
2016/0072259 A1 * 3/2016 Kinoshita ..... H01T 13/32 313/141

FOREIGN PATENT DOCUMENTS

JP 07073956 A * 3/1995
JP 2010209837 A * 9/2010
JP 6225033 B2 * 11/2017 ..... H01T 13/52

* cited by examiner

IGNITION CONTROL SYSTEM AND IGNITION CONTROL DEVICE

CROSS-REFERENCE TO RELATED APPLICATION

The present application is a continuation application of International Application No. PCT/JP2017/042415, filed Nov. 27, 2017, which claims priority to Japanese Patent Application No. 2016-243190, filed Dec. 15, 2016. The contents of these applications are incorporated herein by reference in their entirety.

BACKGROUND

Technical Field

The present disclosure relates to an ignition control system and an ignition control device that are used in an internal combustion engine.

Related Art

An ignition device provided in an internal combustion engine (hereinafter referred to as engine) supplies a primary current to a primary coil connected to a power supply to store magnetic energy in the ignition coil. Then, when the primary current is cut off, a voltage generated in the secondary coil is applied to a center electrode of a spark plug to cause spark discharge between the center electrode and a ground electrode.

SUMMARY

The present disclosure provides an ignition control system. In the present disclosure, an ignition control system includes a spark plug, an ignition coil, and a primary current control unit. The spark plug includes a cylindrical ground electrode, a cylindrical insulator having a protruding portion held inside the ground electrode and protruding toward a tip side the spark plug relative to the ground electrode, and a center electrode held inside the insulator and exposed from the insulator. The ignition coil includes a primary coil and a secondary coil. The primary current control unit performs creeping discharge control for generating a creeping discharge along a surface of the insulator, and air discharge transition control for stopping the creeping discharge occurring in the spark plug after the creeping discharge control is performed and cutting off primary current after a discharge stop period ends, in one combustion cycle of the engine.

DETAILED DESCRIPTION OF THE PREFERRED EMBODIMENTS

Figure 1:
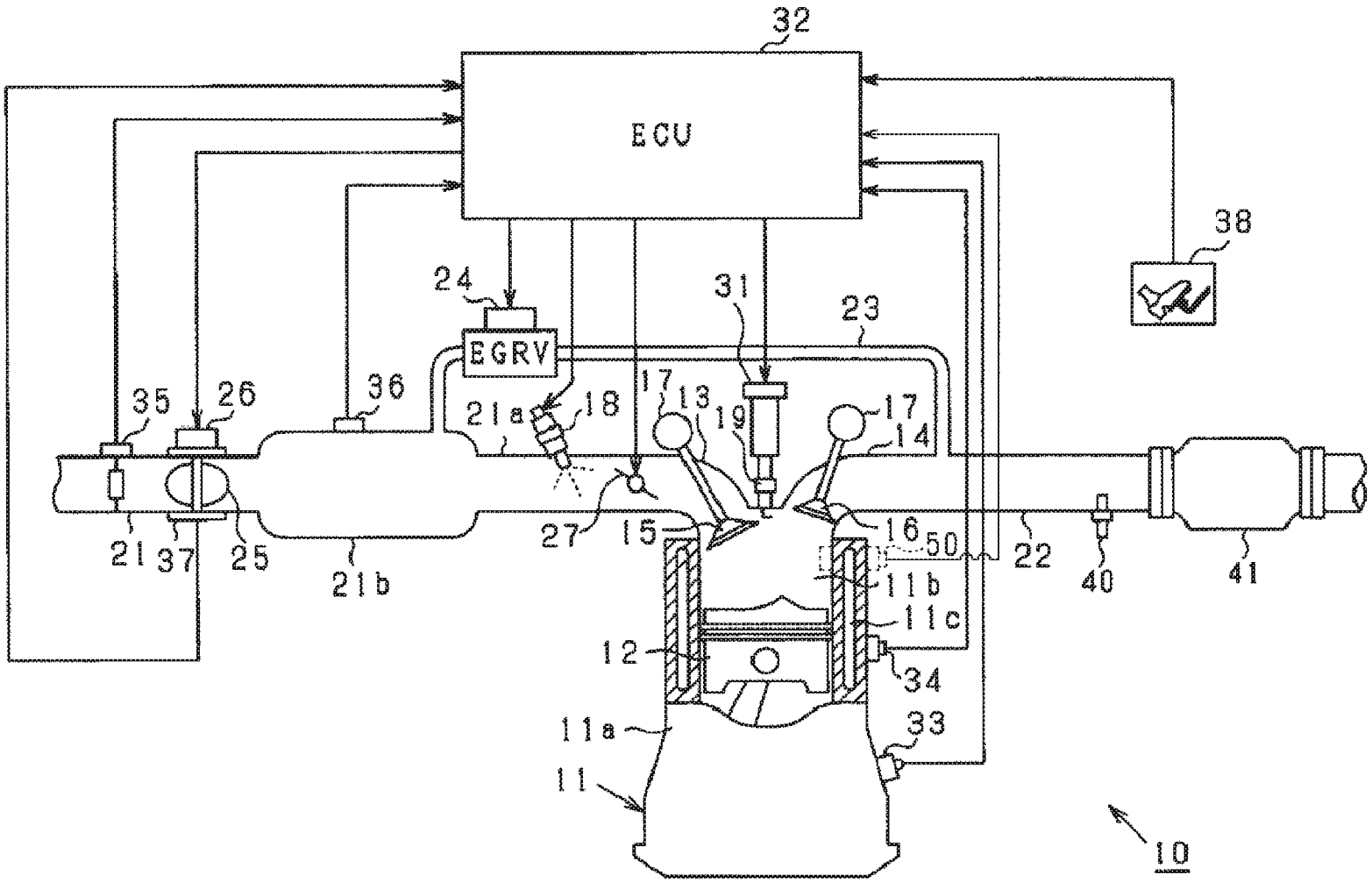
FIG. 1 is a schematic view of an engine system according to the present embodiment.

The inventor of the present disclosure has studied the following technique related to an ignition control system.

In spark plugs, there is a spark plug in which a cylindrical insulator is disposed on the inside of a cylindrical ground electrode such that the tip of the insulator protrudes, and a center electrode is disposed on the inside of the insulator. In an igniter having the spark plug, a voltage is applied to a path of the spark discharge, so that a creeping discharge is generated in such a manner to cover a surface of the insulator. At the time, when the creeping discharge is along the surface of the insulator, cooling energy loss of the discharge in the insulator is large, and energy transfer efficiency to combustible mixture decreases, so that ignitability of the combustible mixture may be deteriorated.

As a countermeasure, in the spark plug disclosed in JP 2016-58196 A, a ground electrode is provided with a shortest discharge forming portion where the distance to a center electrode is shortest, and a creeping discharge is easily started at the shortest discharge forming portion. When the spark plug is mounted to the engine so that the alignment direction of the center electrode and the shortest discharge forming portion is perpendicular to a direction of airflow, the direction of the creeping discharge formed starting from the shortest discharge forming portion becomes approximately perpendicular to the direction of the airflow flowing in the combustion chamber. Therefore, the creeping discharge generated by the spark plug is pulled and extended efficiently in a state in which the spark discharge is continuously generated in the spark plug by the airflow flowing in the combustion chamber, and the creeping discharge can be pulled away from a surface of the insulator with high probability.

However, the direction of the airflow flowing in the combustion chamber is not always constant depending on an operating state such as a rotational speed and load of the engine, and a position of a piston at an ignition timing. That is, in the spark plug described in PTL 1, the direction of the airflow flowing in the combustion chamber is not always perpendicular to the discharge generated by the spark plug. For the reason, it is thought that the more the flow direction of the airflow is deviated from the direction perpendicular to the direction of the discharge generated by the spark plug, the discharge generated by the spark plug is less likely to flap in the airflow flowing in the combustion chamber. Therefore, the discharge becomes more difficult to extend.

The present disclosure is made to solve the above-described problems, the main object of which is to provide an ignition control system and an ignition control device, capable of suppressing cooling loss of discharge occurring in a spark plug without changing the configuration of the spark plug.

In accordance with an aspect of the present disclosure, there is provided an ignition control system including a spark plug mounted in an engine, including a cylindrical ground electrode, a cylindrical insulator having a protruding portion held inside the ground electrode and protruding toward a tip side of the spark plug relative to the ground electrode, and a center electrode held inside the insulator and exposed from the insulator, an ignition coil including a primary coil and a secondary coil, and applying a secondary voltage to the spark plug using the secondary coil, and a primary current control unit performing creeping discharge control for generating a creeping discharge along a surface of the insulator by cutting off primary current after the primary current supplies through the spark plug, and air discharge transition control for stopping the creeping discharge occurring in the spark plug by supplying the primary current through the primary coil after the creeping discharge control is performed, and cutting off the primary current in one combustion cycle of the engine after a discharge stop period as a time required for transition to an air discharge in which a discharge occurs at a position away from the insulator, ends.

Since the creeping discharge occurs along the surface of the insulator, the cooling energy loss of the discharge at the insulator is large, and the energy transfer efficiency to the combustible mixture decreases, and the ignitability of the combustible mixture may deteriorate. Therefore, in order to suppress the deterioration of the ignitability of the combustible mixture, it is necessary to separate the discharge from the surface of the insulator.

For the reason, the present ignition control system is provided with a primary current control unit. In the primary current control unit, first, creeping discharge control is performed to cause the spark plug to generate a creeping discharge. Then, primary current supplies through the primary coil, so that the creeping discharge occurring in the spark plug is stopped and energy in the primary coil is stored. The generation of the creeping discharge ionizes neutral molecules in the air to generate electric charges. The generated electric charges are present even after the stop of the creeping discharge, and flow in the direction away from the insulator due to the airflow in the combustion chamber of the engine during a discharge stop period. The discharge generated by cutting off the primary current after the discharge stop period ends generates an air discharge in such a manner to pass through electric charges present at a position away from the insulator. Thus, the creeping discharge can be efficiently converted to an air discharge by performing the air discharge transition control without changing the configuration of the spark plug. As a result, it is possible to suppress the cooling loss of the discharge occurring in the spark plug.

The above-described object, other objects, features and advantages in the present disclosure will become more apparent from the following detailed description with reference to the accompanying drawings.

Referring to FIG. 1, an engine system 10 includes an engine 11 that is a spark ignition type internal combustion engine. The engine system 10 changes and controls an air-fuel ratio of a combustible mixture to a rich side or a lean side with respect to a stoichiometric air-fuel ratio in accordance with an operating state of the engine 11. For example, when the operating state of the engine 11 is in a low speed light load operating region, the air-fuel ratio of the combustible mixture is controlled to the lean side.

The engine 11 includes an engine block 11*a* that constitutes a main body of the engine 11 and has a combustion chamber 11*b* and a water jacket 11*c*. The engine block 11*a* is configured to accommodate a piston 12 in such a manner to be able to reciprocate. A water jacket 11*c* is a space through which coolant (also referred to as cooling water) can flow, and is provided in such a manner as to surround the combustion chamber 11*b*.

An intake port 13 and an exhaust port 14 are formed in a cylinder head, which is an upper portion of the engine block 11*a*, in such a manner to communicate with the combustion chamber 11*b*. The cylinder head is also provided with an intake valve 15 for controlling a communication state between the intake port 13 and the combustion chamber 11*b*, an exhaust valve 16 for controlling a communication state between the exhaust port 14 and the combustion chamber 11*b*, and a drive mechanism 17 for opening and closing the intake valve 15 and the exhaust valve 16 at a predetermined timing.

An intake manifold 21*a* is connected to the intake port 13. The intake manifold 21*a* is provided with an electromagnetically driven injector 18 to which high-pressure fuel is supplied from a fuel supply system. The injector 18 is a port injection type fuel injection valve that injects fuel toward the intake port 13 as the injector is energized.

A surge tank 21*b* is disposed upstream of the intake manifold 21*a* in an intake flow direction. An exhaust pipe 22 is connected to the exhaust port 14.

An Exhaust Gas Recirculation (EGR) passage 23 is provided so that a part of exhaust gas exhausted to the exhaust pipe 22 can be introduced to intake air by connecting the exhaust pipe 22 to the surge tank 21*b* (hereinafter, referred to as EGR gas, which is exhaust gas introduced into the intake air). An EGR control valve 24 is interposed in the EGR passage 23. The EGR control valve 24 is provided so as to be able to control an EGR rate (a mixing ratio of the EGR gas in pre-combustion gas sucked into the combustion chamber 11*b*) in accordance with an opening degree thereof.

A throttle valve 25 is interposed upstream of the surge tank 21*b* in an intake air flow direction in an intake pipe 21. The opening degree of the throttle valve 25 is controlled by an operation of a throttle actuator 26 such as a DC motor. An air flow control valve 27 for generating a swirl flow and a tumble flow is provided in a vicinity of the intake port 13.

The exhaust pipe 22 is provided with a catalyst 41 such as a three-way catalyst for purifying CO, HC, and NOx in the exhaust gas, and an air-fuel ratio sensor 40 (such as a linear A/F sensor) for detecting the air-fuel ratio of the combustible mixture with the exhaust gas as a detection target on an upstream side of the catalyst 41.

The engine system 10 includes an ignition circuit unit 31 and an electronic control unit 32.

The ignition circuit unit 31 is configured to cause a spark plug 19 to generate a discharge spark for igniting the combustible mixture in the combustion chamber 11*b*. The electronic control unit 32 is a so-called Electronic Control Unit (ECU), and controls an operation of each unit or device including the injector 18 and the ignition circuit unit 31 in accordance with an operating state of the engine 11, acquired based on outputs of various sensors such as the crank angle sensor 33.

With regard to ignition control, the electronic control unit 32 generates and outputs an ignition signal IGt based on the acquired operating state of the engine 11. The ignition signal IGt defines an optimum ignition timing and an optimum primary current flow time in accordance with a state of gas in the combustion chamber 11*b* and a required output of the engine 11 (i.e fluctuates in accordance with the operating state of the engine 11).

The crank angle sensor 33 is a sensor for outputting a rectangular crank angle signal (for example, at a cycle of 30° CA) for each predetermined crank angle of the engine 11. The crank angle sensor 33 is mounted on the engine block 11*a*. A cooling water temperature sensor 34 is a sensor for detecting (acquiring) a cooling water temperature that is a temperature of cooling fluid flowing in the water jacket 11*c*, and is mounted on the engine block 11*a*.

An air flow meter 35 is a sensor for detecting (acquiring) an intake air amount (a mass flow rate of the intake air that flows through the intake pipe 21 and is introduced into the combustion chamber 11*b*). The air flow meter 35 is attached to the intake pipe 21 on the upstream side of the throttle valve 25 in the intake air flow direction. An intake pressure sensor 36 is a sensor for detecting (acquiring) an intake pressure that is a pressure in the intake pipe 21, and is attached to the surge tank 21*b*.

A throttle opening degree sensor 37 is a sensor for generating an output corresponding to the opening degree (throttle opening degree) of the throttle valve 25, and is integrated with the throttle actuator 26. An accelerator position sensor 38 is provided to generate an output corresponding to an accelerator operation amount.

<Configuration Around Ignition Circuit Unit>

Figure 2:
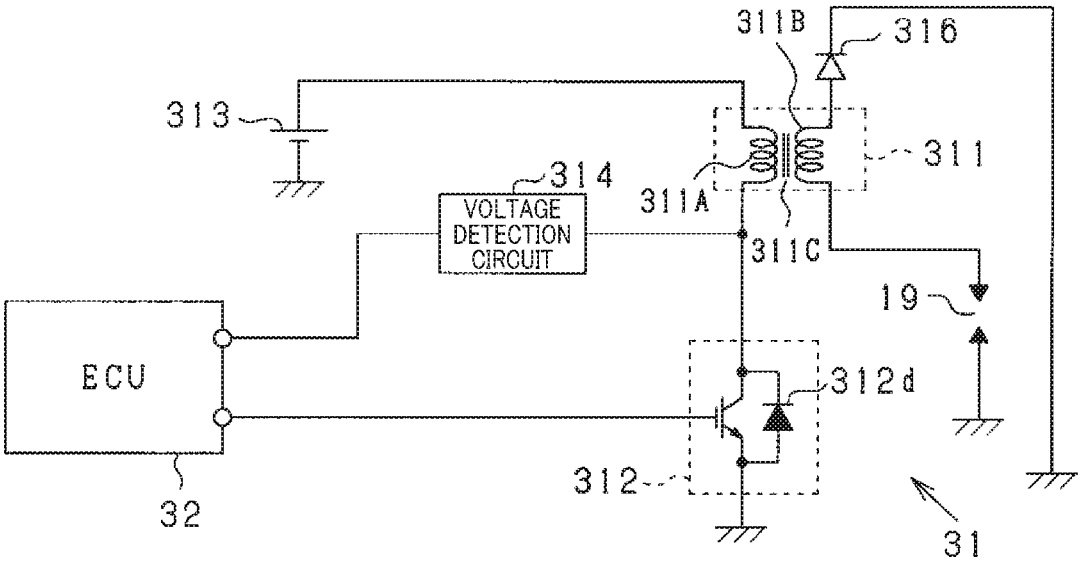
FIG. 2 is a schematic view of an ignition circuit unit shown in FIG. 1.

Referring to FIG. 2, the ignition circuit unit 31 is provided with an ignition coil 311, an IGBT 312, a power supply unit 313, and a voltage detection circuit 314.

The ignition coil 311 includes a primary coil 311A, a secondary coil 311B, and an iron core 311C. A first end of the primary coil 311A is connected to the power supply unit 313, and a second end of the primary coil 311A is connected to a collector terminal of the IGBT 312. An emitter terminal of the IGBT 312 is connected to the ground side. A diode 312*d* is connected in parallel to both ends (collector terminal and emitter terminal) of the IGBT 312.

The voltage detection circuit 314 that detects a primary voltage V1 applied to the primary coil 311A is connected between the second end of the primary coil 311A and the collector terminal of the IGBT 312. The voltage detection circuit 314 detects the primary voltage V1 applied to the primary coil 311A and outputs the primary voltage V1 to the electronic control unit 32. Therefore, the voltage detection circuit 314 corresponds to a voltage value detection unit.

The first end of the secondary coil 311B is connected to the ground side via a diode 316. The first end of the secondary coil 311B may be configured to be connected to the first end side of the primary coil 311A via the diode 316. The diode 316 prohibits a flow of current in a direction from the ground side to the second end side of the secondary coil 311B. An anode of the diode 316 is connected to the first end side of the secondary coil 311B so that a secondary current (discharge current) is defined to flow in a direction from the spark plug 19 to the secondary coil 311B.

The second end of the secondary coil 311B is connected to the spark plug 19 that is present near the ignition circuit unit 31.

Figure 3:
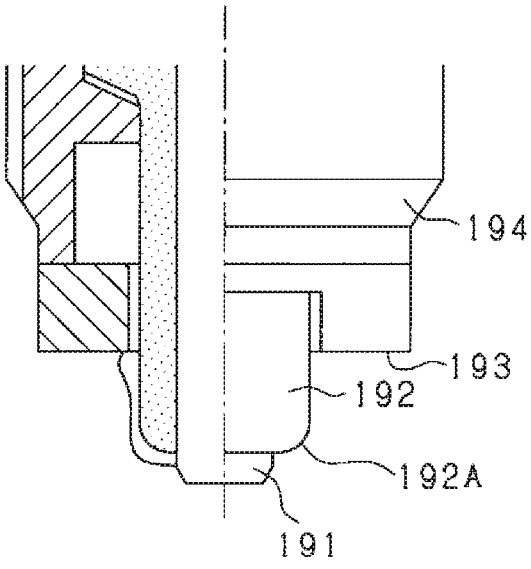
FIG. 3 is a schematic view of a spark plug shown in FIG. 1.

With reference to FIG. 3, the following will schematically describe the configuration of the spark plug 19. The spark plug 19 includes a rod-shaped center electrode 191, a cylindrical insulator 192 (corresponding to insulator), a cylindrical ground electrode 193, and a housing 194. The insulator 192 held inside the ground electrode 193 holds the center electrode 191 inside the insulator 192 in such a manner to cover an outer periphery of the center electrode 191, so that electrical insulation between the center electrode 191 and the housing 194, and between the center electrode 191 and the ground electrode 193 is secured. A base end side of the insulator 192 is crimped and fixed on the spark plug 19 by a housing 194. The insulator 192 forms a protruding portion 192A that protrudes toward a tip side of the spark plug 19 relative to the ground electrode 193. The center electrode 191 is held inside the cylindrical insulator 192 and is disposed in such a manner to project more toward the tip side of the spark plug 19 than the projecting portion 192A of the insulator 192 does. A creeping glow discharge (hereinafter referred to as creeping discharge) occurs in such a manner to extend from a surface of the ground electrode 193 toward the tip of the center electrode 191 that protrudes along the insulator 192. The electronic control unit 32 generates the ignition signal IGt based on the operation state of the engine 11, acquired as described above, and outputs the generated ignition signal IGt to a gate terminal of the IGBT 312, so that the IGBT 312 is controlled to supply a primary current I1 through the primary coil 311A. Then, when a first predetermined time ends after the electronic control unit 32 outputs the ignition signal IGt to the gate terminal of the IGBT 312, the electronic control unit 32 stops the output of the ignition signal IGt. As a result, the IGBT 312 is controlled to cut off the primary current I1 supplying through the primary coil 311A (hereinafter, the present control is referred to as creeping discharge control). As a result, a high voltage is induced in the secondary coil 311B, and a creeping discharge occurs between the discharge electrodes of the spark plug 19 (between the ground electrode 193 and the center electrode 191).

Since the creeping discharge occurs along the surface of the insulator 192, the cooling energy loss of the discharge is large, so that the energy transfer efficiency to the combustible mixture decreases, and the ignitability of the combustible mixture may deteriorate. Therefore, in order to suppress the deterioration of the ignitability of the combustible mixture, it is necessary to convert the creeping discharge to the air discharge discharging at a position away from the insulator 192.

The electronic control unit 32 according to the present embodiment performs the creeping discharge control as the control for transferring the creeping discharge to the air discharge and then performs the following air discharge transition control. Therefore, the electronic control unit 32 corresponds to a primary current control unit.

After the creeping discharge control is performed (after the IGBT 312 is controlled to cut off the primary current I1 supplying through the primary coil 311A) and then a second predetermined time that is set as a time when it is assumed that electric charges described in details later are sufficiently generated, ends, the electronic control unit 32 controls the IGBT 312 to supply the primary current I1 through the primary coil 311A. Thus, the creeping discharge occurring in the spark plug 19 is stopped. Then, after a lapse of the discharge stop period, the IGBT 312 is controlled to cut off the primary current I1 supplying through the primary coil 311A.

Figure 4:
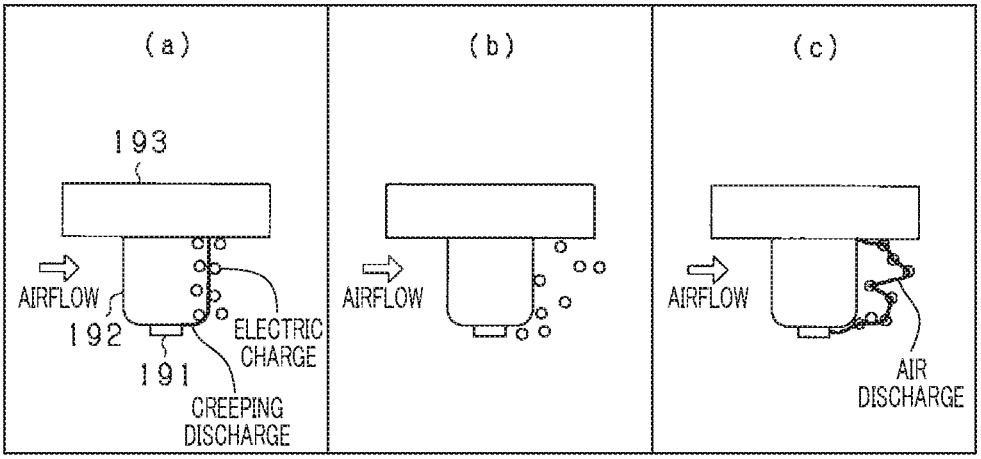
FIG. 4 is a view of schematically showing transition of a creeping discharge to an air discharge.

As shown in FIG. 4 (*a*), when a creeping discharge occurs at the spark plug 19, neutral molecules present in the air are ionized and then electric charges are generated. As shown in FIG. 4 (*b*), the generated electric charges are present even after the creeping discharge stops, and are flowed in a direction away from the insulator 192 by airflow in the combustion chamber 11*b* during the discharge stop period. Then, after the discharge stop period ends, the IGBT 312 is controlled to cut off the primary current I1, so that, as shown in FIG. 4 (*c*), an air discharge can be generated in such a manner to pass through the electric charges present at a position away from the insulator 192.

Figure 5:
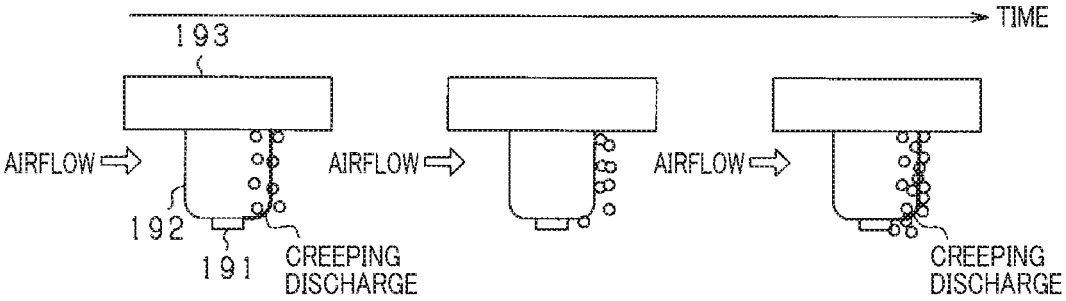
FIG. 5 is a schematic view in a case of performing air discharge transition control in which a discharge stop period is set short.
Figure 6:
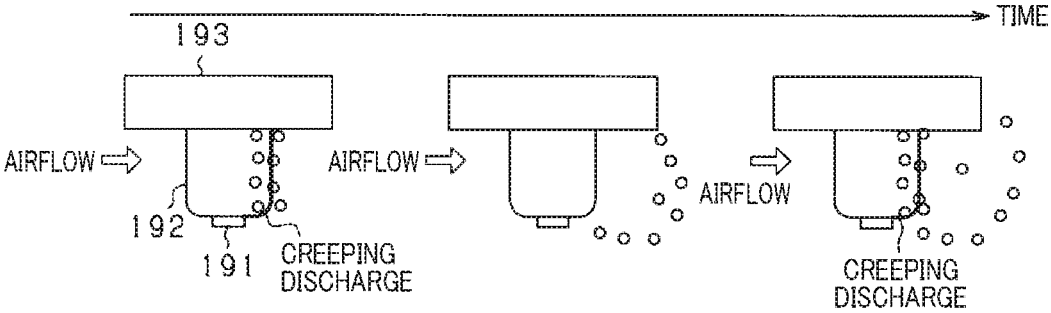
FIG. 6 is a schematic view in a case of performing the air discharge transition control in which the discharge stop period is set long.

By the way, when the discharge stop period is set to be short, it is assumed that the electric charges cannot move over a distance necessary to generate the air discharge, and remain around the insulator 192 until the discharge stop period ends after the IGBT 312 is controlled to supply the primary current I1 through the primary coil 311A as shown in FIG. 5. In the case, a creeping discharge is generated again. On the other hand, when the discharge stop period is set to be long, it is assumed that the electric charges are blown by the airflow and separate away from both the insulator 192 and the ground electrode 193 until the discharge stop period ends after the IGBT 312 is controlled to supply the primary current I1 through the primary coil 311A as shown in FIG. 6. In the case, it is difficult to generate a discharge in such a manner to pass through the electric charges. A creeping discharge may be generated again.

As described above, it is assumed that the creeping discharge cannot be converted to an air discharge even if the discharge stop period is short or long. Therefore, in order to efficiently produce the air discharge, it is necessary to set the discharge stop period such that the primary current I1 supplying through the primary coil 311A is cut off when the electric charges blow to a position adequately separated from the insulator 192. The moving speed of the electric charges during the discharge stop period depends on a flow rate v of gas flowing in the combustion chamber 11*b*, and the flow rate v of the gas flowing in the combustion chamber 11*b* fluctuates depending on an operating state of the engine 11. As a result, the moving speed of the electric charges during the discharge stop period can be grasped from the operating state of the engine 11. Therefore, in the present embodiment, a map in which the discharge stop period is determined in accordance with the operating state of the engine 11, is stored in the electronic control unit 32 in advance. The map is referred to before performing the air discharge transition control, so that the discharge stop period is variably set in accordance with the current operating state of the engine 11.

Figure 7:
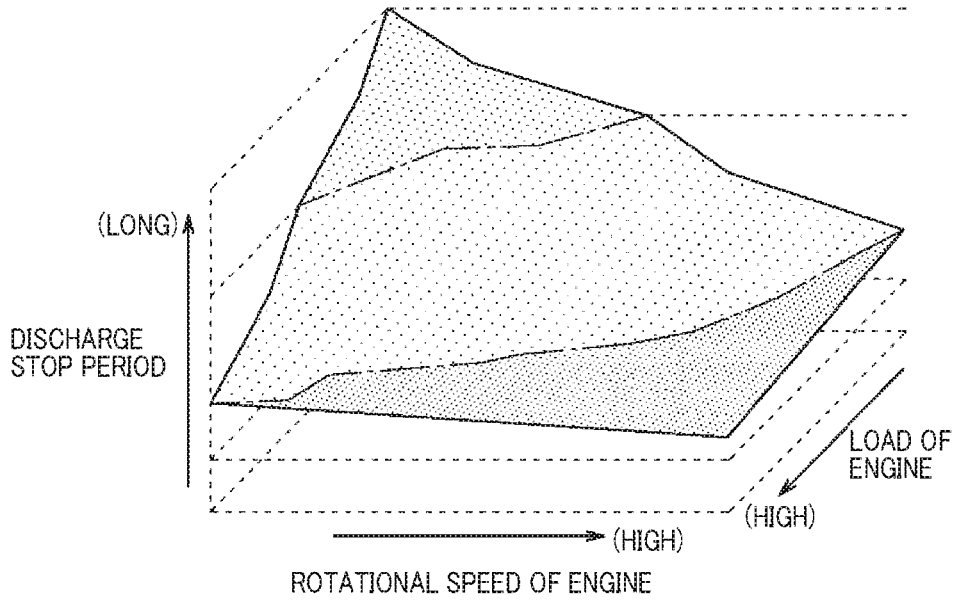
FIG. 7 is a diagram showing how to set the discharge stop period in accordance with a change in a rotational speed and load of an engine.

For example, as load on the engine 11 becomes higher, the flow rate v of gas flowing in the combustion chamber 11*b* becomes higher. Similarly, as a rotational speed of the engine 11 becomes higher, the flow rate v of the gas flowing in the combustion chamber 11*b* becomes higher. As the flow rate v of the gas becomes higher, electric charges generated by generation of a creeping discharge flow downstream earlier. As a result, as shown in FIG. 7, the map stored in advance includes a relationship that the discharge stop period becomes shorter as the rotational speed of the engine 11 is higher or the load on the engine 11 is higher. Thus, in the operating state of the engine 11 in which the flow rate v of the gas becomes high, the discharge stop period can be set short. Therefore, the primary current I1 flowing through the primary coil 311A can be cut off by the IGBT 312 before the electric charges separate from the ground electrode 193 or the center electrode 191 too much, and an occurrence probability of an air discharge can be improved.

Figure 8:
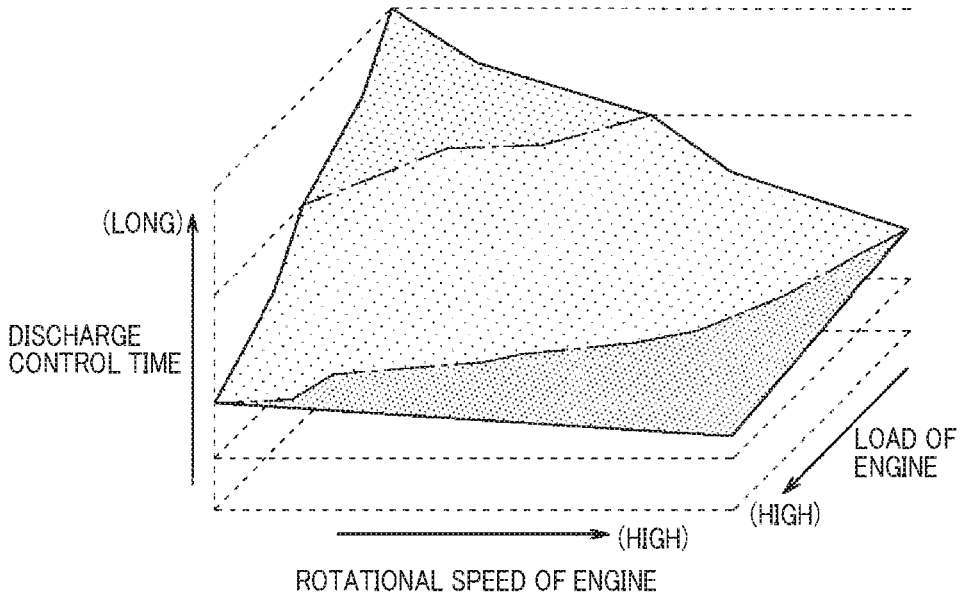
FIG. 8 is a diagram showing how to set the discharge control period in accordance with the change in the rotational speed and the load of the engine.

Depending on a relationship among a position where a creeping discharge occurs in the spark plug 19, an airflow direction, and a flow rate in the combustion chamber 11*b*, electric charges cannot be sufficiently separated from the insulator 192 only by performing the air discharge transition control described above once, so that there is a possibility that the creeping discharge cannot be converted to the air discharge. For the reason, in the present embodiment, after the creeping discharge control is performed, the air discharge transition control is repeatedly performed until a predetermined discharge control time ends. Thus, the electric charges can be sufficiently separated from the insulator 192. However, in an operating state of the engine 11, in which the flow rate v of the gas increases, it is assumed that the transition from the creeping discharge to the air discharge is made early. For the reason, as shown in FIG. 8, the map is stored in advance that has a relationship in which the discharge control time becomes shorter as the rotational speed of the engine 11 is higher or as the engine load is higher. Then, before performing the air discharge transition control, the discharge stop period is changed in accordance with the current operation state of the engine 11 with reference to the map.

When a predetermined discharge control time ends after the air discharge transition control is performed, the air discharge transition control is ended, and the IGBT 312 is controlled to continue a state in which the primary current I1 supplying through the primary coil 311A is cut off. Thus, the air discharge generated by the spark plug 19 can be maintained continuously.

Figure 9:
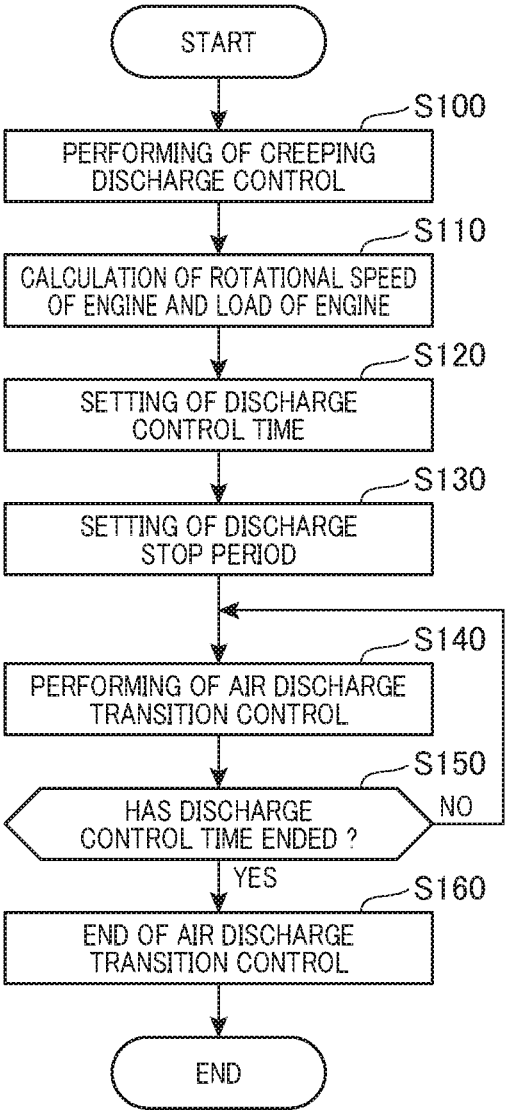
FIG. 9 is a control flowchart executed by an electronic control unit according to the present embodiment.

In the present embodiment, the electronic control unit 32 performs the discharge control shown in FIG. 9, described later. The discharge control shown in FIG. 9 is repeatedly performed by the electronic control unit 32 at a predetermined cycle based on the rotational speed of the engine 11 during the operation of the engine 11.

At step S100, the creeping discharge control is performed by controlling the IGBT 312 to cut off the primary current I1 supplying through the primary coil 311A. At step S110, the rotational speed of the engine 11 and the load of the engine 11 are calculated. The rotational speed of the engine 11 can be calculated based on the crank angle signal outputted by the crank angle sensor 33. The load of the engine 11 can be calculated based on, for example, an intake pressure detected by the intake pressure sensor 36 or an accelerator operation amount detected by the accelerator position sensor 38.

At step S120, the discharge control time is set with reference to the map, based on the rotational speed of the engine 11 and the load of the engine 11 that are calculated in step S110. At step S130, the discharge stop period is set with reference to the map based on the rotational speed of the engine 11 and the load of the engine 11 that are detected in step S110.

At step S140, the air discharge transition control is performed in the discharge stop period that is set in step S130. At step S150, it is determined whether the discharge control time set in step S120 has ended after the creeping discharge control is performed in step S100. When it is determined that the discharge control time set in step S120 has not ended after the creeping discharge control is performed in step S100 (S150: NO), the process returns to step S140. When it is determined that the discharge control time set in step S120 has ended after the creeping discharge control is performed in step S100 (S150: YES), the process proceeds to step S160. At step S160, the air discharge transition control is ended, and the IGBT 312 is controlled to continue the state in which the primary current I1 supplying through the primary coil 311A is cut off. Thus, the present control is ended.

The process of step S100 corresponds to a process by the creeping discharge control unit. The process of step S140 corresponds to a process by the air discharge control unit.

In accordance with the above configuration, the present embodiment has the following effects.

After the creeping discharge control is performed, the air discharge transition control is performed, so that the creeping discharge can be efficiently transferred to the air discharge without changing the configuration of the spark plug 19. As a result, it is possible to suppress the cooling loss of the discharge occurring in the spark plug 19.

The discharge stop period is variably set in accordance with the operating state of the engine 11, so that the primary current I1 supplying through the primary coil 311A can be cut off at a position where the electric charges are adequately separated from the insulator 192, and therefore, the air discharge can be generated efficiently.

The map in which the discharge stop period is determined is provided in advance in accordance with the operating state of the engine 11, so that the discharge stop period can be changed in accordance with the operating state of the engine 11 by referring to the map, and therefore, the control can be simplified.

The above embodiment can be modified as follows. Incidentally, the configurations of the following other examples may be applied individually to the configuration of the above embodiment, or may be applied in an arbitrary combination.

In the spark plug 19 according to the above embodiment, the ground electrode 193 and the housing 194 are separately configured. In this regard, the ground electrode 193 and the housing 194 may be integrally configured.

The center electrode 191 provided in the spark plug 19 according to the above-described embodiment is held inside the cylindrical insulator 192 having the protruding portion 192A protruding toward the tip side of the spark plug 19 relative to the ground electrode 193, and protrudes toward the tip side of the spark plug 19 relative to the tip side of the protruding portion 192A. In this regard, any structure may be used as long as a creeping discharge is started on the surface of the insulator 192. For example, the center electrode 191 may be exposed at the same end surface as the tip portion of the insulator 192 or may be exposed at a position where the center electrode 191 is disposed inside the tip surface of the insulator 192.

In the above embodiment, the discharge stop period is variably set in accordance with the operating state of the engine 11. In this regard, the discharge stop period may be a fixed value.

In the above embodiment, the map in which the discharge stop period is determined in accordance with the operating state of the engine 11, is stored in the electronic control unit 32 in advance. In this regard, it is not necessary to store the map in advance. In this case, for example, a reference state for the operating state of the engine 11 is determined in advance, and the discharge stop period in the reference state is determined in advance. In the operating state of the engine 11 in which a flow rate v of gas becomes higher than in the reference state, the discharge stop period, set in the reference state, is set short. In the operating state of the engine 11 in which the flow rate v of gas becomes lower than in the reference state, the discharge stop period set in the reference state is set long.

Similarly, the discharge control time in the reference state is determined in advance. In the operating state of the engine 11 in which the flow rate v of gas is higher than in the reference state, the discharge control time set in the reference state is set short. In the operating state of the engine 11 in which the flow rate v of gas is lower than in the reference state, the discharge control time set in the reference state, is set long.

In the above embodiment, the discharge stop period is variably set in accordance with the operating state of the engine 11. In this regard, when the present ignition circuit unit 31 is applied to the engine 11 provided with a flow rate detection sensor 50 (for example, detectable by a sensor similar to an air flow meter) that detects the flow rate v of gas in the combustion chamber 11*b*, the discharge stop period may be changed in accordance with the flow rate v of the gas detected by the flow rate detection sensor 50. Since the moving speed of the electric charges can be estimated with high accuracy from the flow rate v of the gas detected by the flow rate detection sensor 50, the discharge stop period can be set more preferably so that the primary current I1 supplying through the primary coil 311A is cut off at a position where the electric charges are adequately separated from the insulator 192. As a result, the air discharge can be generated efficiently. The flow rate detection sensor 50 corresponds to a flow rate detection unit.

Figure 10:
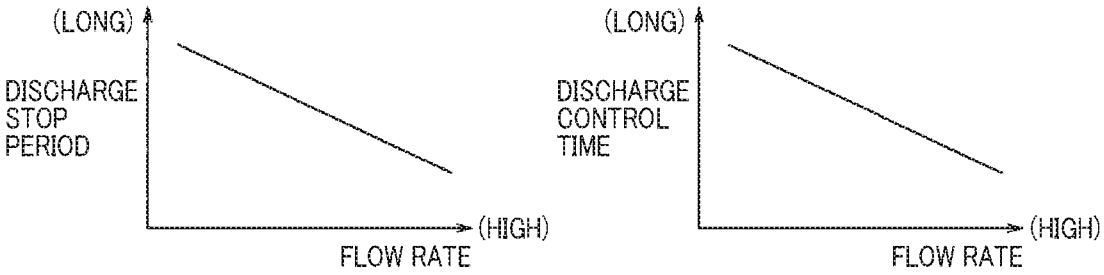
FIG. 10 is a diagram showing how to set the discharge stop period and the discharge control period in accordance with the change in a flow rate of gas flowing in a combustion chamber.

The following will describe a specific method of changing the discharge stop period in accordance with the flow rate v of gas. When the flow rate v of the gas is high, the electric charges generated by the generation of the creeping discharge flow downstream rapidly. As a result, as the flow rate v of the gas is higher, the discharge stop period is set to be shorter, as shown in FIG. 10. Thus, the primary current I1 supplying through the primary coil 311A can be cut off before the electric charges are separated from the ground electrode 193 or the center electrode 191 too much. As a result, an occurrence probability of the air discharge can be improved.

In addition, while the discharge stop period is variably set in accordance with the flow rate v of the gas, it is assumed that in the state where the flow rate v of the gas is high, the creeping discharge is converted to the air discharge early. As a result, it is preferable to set the discharge control time shorter as the flow rate v of the gas is higher, as shown in FIG. 10.

In the present alternative example, the flow rate detection sensor 50 detects the flow rate v of the combustible mixture in the combustion chamber 11*b*. In this regard, the flow rate detection sensor 50 does not necessarily have to be provided. For example, the primary voltage of the primary coil 311A, the secondary voltage of the secondary coil 311B, or the secondary current supplying through the secondary coil 311B, which are necessary to maintain discharge, is detected. Then, the flow rate v of the combustible mixture flowing in the combustion chamber 11*b* may be estimated from the detected change of the primary voltage, the secondary voltage, or the secondary current. Since the estimation method of the flow rate v of the combustible mixture is based on a conventional estimation method, the specific description is omitted.

In the above embodiment, the discharge stop period is variably set in accordance with the operating state of the engine 11. In this regard, the discharge stop period may be set within a range from a time when the electric charges generated by the generation of the creeping discharge in the spark plug 19 reach a radial inner end of the ground electrode 193 to a time when the electric charges generated by the generation of the creeping discharge in the spark plug 19 reach a radial outer end of the ground electrode 193.

Figure 11:
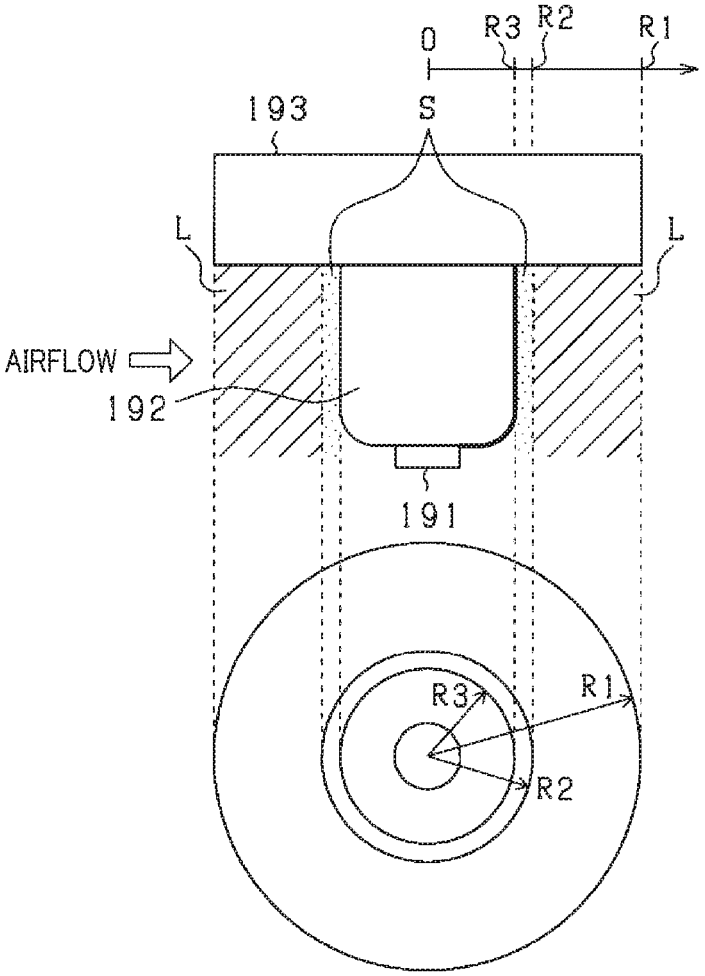
FIG. 11 is a schematic view of showing a positional relationship among a center electrode, a ground electrode, and an insulator in the spark plug.

The following will be described with reference to FIG. 11. When the IGBT 312 is controlled to cut off the primary current I1 supplying through the first coil 311A within a period in which electric charges generated by a creeping discharge are present in a region from the insulator 192 to the radial inner end of the ground electrode 193 (hereinafter referred to as region S), the electric charges are close to the spark plug 19, so that there is a high possibility that the creeping discharge will occur again. On the other hand, when the primary current I1 supplying through the first coil 311A is cut off by the IGBT 312 within a period in which electric charges generated by creeping discharge are present in a region from the radial inner end of the ground electrode 193 to the radial outer end of the ground electrode 193 (hereinafter referred to as region L), there is a high possibility that air discharge will occur again. Further, when the primary current I1 supplying through the first coil 311A is cut off by the IGBT 312 within a period in which electric charges generated by creeping discharge are present at a position separated from the radial outer end of the ground electrode 193, air discharge cannot be performed because the electric charges are not present between the discharge electrodes of the spark plug 19, so that there is a high possibility that a creeping discharge will occur again.

As described above, the discharge stop period is set within a period in which the electric charges generated by the generation of the creeping discharge in the spark plug 19 are present in the region L. Thus, the occurrence probability of an air discharge can be improved.

The following will describe a method of calculating a time when electric charges generated by the generation of the creeping discharge in the spark plug 19 reach the radial inner end of the ground electrode 193 and a time when the electric charges reach the radial outer end of the ground electrode 193. It is noted that the ignition control system according to the present alternative example is explained supposing to be mounted in the engine 11 provided with the flow rate detection sensor 50.

The difference obtained by subtracting a diameter R3 of the insulator 192 from an inner diameter R2 of the ground electrode 193 corresponds to a diameter R2-R3 from the insulator 192 to the radial inner end of the ground electrode 193. As a result, a time when electric charges present around the insulator 192 move in the direction away from the insulator 192 and then reach the radial inner end of the ground electrode 193 can be calculated by dividing the diameter R2-R3 by the flow rate v of gas flowing in the combustion chamber 11*b* detected by the flow rate detection sensor 50. On the other hand, the difference obtained by subtracting the diameter R3 of the insulator 192 from the outer diameter R1 of the ground electrode 193 corresponds to a diameter R1-R3 from the insulator 192 to the radial outer end of the ground electrode 193.

Therefore, a time when the electric charges present around the insulator 192 move in the direction away from the insulator 192 and then reach the radial outer end of the insulator 192 can be calculated by dividing the diameter R1-R3 by the flow rate v of gas flowing in the combustion chamber 11*b* detected by the flow rate detection sensor 50.

As a result, a period in which the electric charges generated by the generation of the creeping discharge in the spark plug 19 are present in the region L, corresponds to a range that is from a first value to a second value. The first value is a value obtained by a calculation in which the difference obtained by subtracting the diameter R3 of insulator 192 from the inner diameter R2 of the ground electrode 193, is divided by the flow rate v of the gas flowing in the combustion chamber 11*b* detected by the flow rate detection sensor 50. The second value is a value obtained by a calculation in which the difference obtained by subtracting the diameter R3 of the insulator 192 from the outer diameter R1 of the ground electrode 193, is divided by the flow rate v of the gas flowing in the combustion chamber 11*b* detected by the flow rate detection sensor 50. The discharge stop period is set within the corresponding range, so that the primary current I1 supplying through the primary coil 311A can be cut off during the period in which the electric charges present near the insulator 192 are present in the region L, and therefore, the occurrence probability of the air discharge can be improved.

In the above embodiment, the air discharge transition control is repeatedly performed until a predetermined discharge control time ends after the creeping discharge control is performed. In this regard, a predetermined discharge control time is not necessarily provided, and the air discharge transition control may be configured to be performed only once.

(1) In the above embodiment, the air discharge transition control is repeatedly performed until a predetermined discharge control time ends after creeping discharge control is performed. In this regard, instead of providing a predetermined discharge control time, the electronic control unit 32 may be configured to perform an air discharge determination process described later, which determines whether a discharge occurring at the spark plug 19 is an air discharge. The electronic control unit 32 according to the present alternative example corresponds to an air discharge determination unit.

In the present configuration, when it is determined that the discharge occurring at the spark plug 19 is not an air discharge, the electric charges are still present near the insulator 192, and therefore, it is assumed that the creeping discharge occurs, so that the discharge transition control is repeated. Thus, the electric charges can move downstream, and the electric charges in the air dischargeable region increase when the air discharge transition control is performed several times, so that the air discharge can be generated. When it is determined that the discharge which occurs in the spark plug 19 is an air discharge, the air discharge transition control is ended to maintain the air discharge, and the IGBT 312 continues to cut off the primary current I1 supplying through the primary coil 311A. As a result, the air discharge can be maintained for a long time, and the ignitability of the combustible mixture can be improved.

In the present alternative example, after the air discharge transition control is performed, the air discharge determination process is performed until the discharge period in which the spark plug 19 should be controlled to discharge in the compression stroke period in one combustion cycle, ends. Therefore, after the air discharge transition control is performed, when the discharge period ends without determining that the discharge occurring in the spark plug 19 is an air discharge, the air discharge transition control is ended and then the air discharge determination process is ended. The discharge period refers to a period in which the spark plug 19 is controlled to discharge in one combustion cycle. The discharge control time refers to a time when the air discharge transition control is performed. In many cases, the discharge control time is included in the discharge period.

The following will specifically describe the air discharge determination process. A length of a discharge spark during an air discharge is longer than that of a discharge spark during a creeping discharge. For the reason, after the primary current I1 is cut off by the IGBT 312 and then a creeping discharge starts in the spark plug 19, the primary voltage V1 necessary for maintaining the discharge is greater in the air discharge than in the creeping discharge. That is, after a first maximum peak of the primary voltage V1 generated by cutting off the primary current I1 by the IGBT 312, the primary voltage V1 necessary for maintaining the discharge is greater in the air discharge than in the creeping discharge. For the reason, it can be determined that the discharge occurring in the spark plug 19 is an air discharge on condition that the primary voltage V1 excluding the maximum peak occurring first becomes greater than a threshold value that is set to be greater than the primary voltage V1 necessary to maintain the creeping discharge, in a period from when the primary current I1 is cut off by the IGBT 312 to when a determination time ends. Although the determination time is set to be longer than the above-described second predetermined time in the present alternative example, the present disclosure is not limited to the configuration. For example, the determination time may set to a time approximately similar to the second predetermined time.

Figure 12:
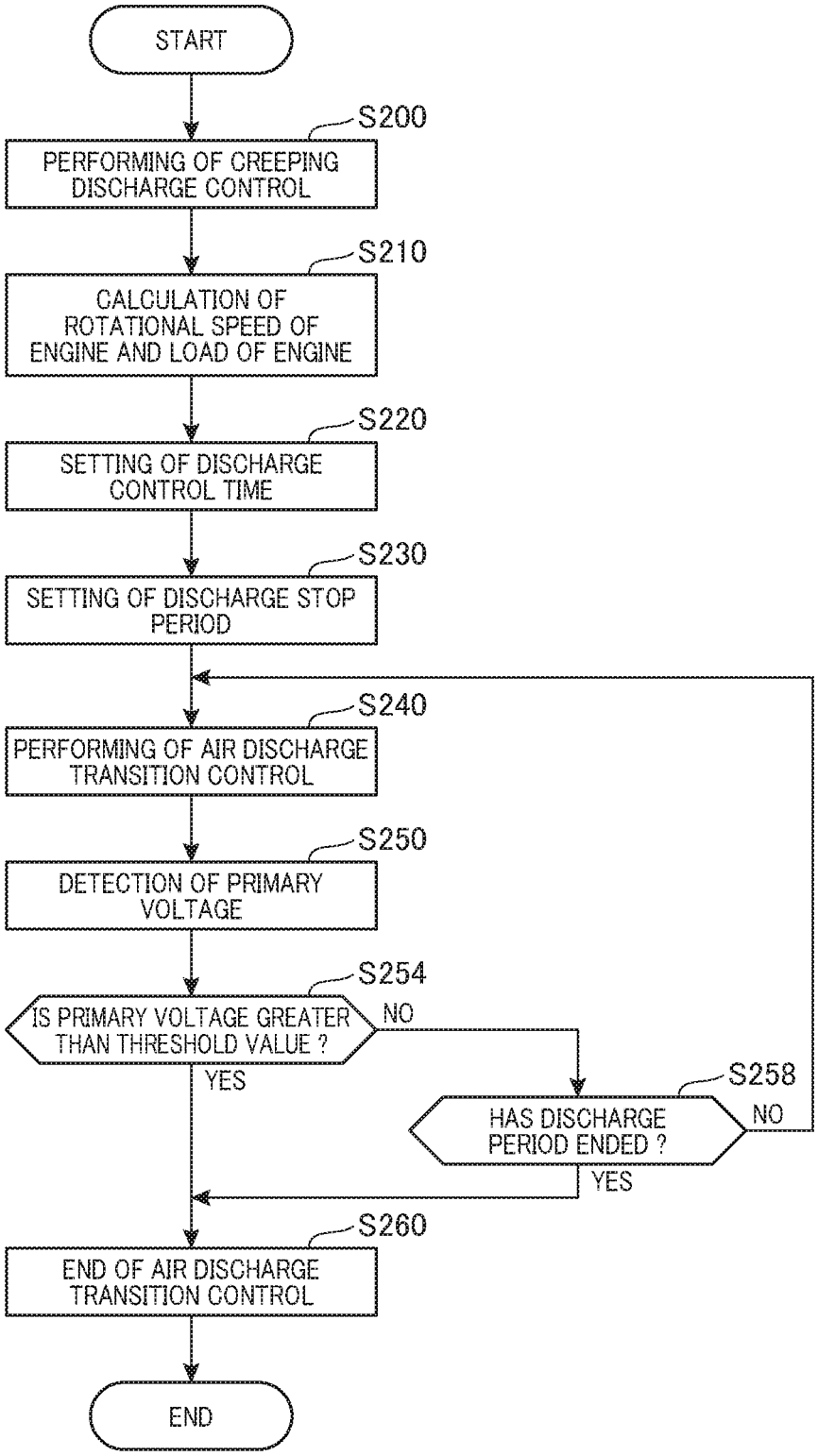
FIG. 12 is a control flowchart executed by the electronic control unit in accordance with an alternative example.

FIG. 12 is a modification of a part of the flowchart of FIG. 9. That is, step S150 in FIG. 9 is deleted, and instead, step S250, step S254, and step S258 are newly added.

After step S240 corresponding to step S140 is performed, the process proceeds to step S250. At step S250, the primary voltage V1 applied to the primary coil 311A, detected by the voltage detection circuit 314 is acquired. At step S254, it is determined whether the primary voltage V1 excluding the maximum peak occurring first becomes greater than a threshold value, in a period from when the primary current I1 is cut off by the IGBT 312 to when a determination time ends. When it is determined that the primary voltage V1 excluding the maximum peak occurring first becomes greater than the threshold value, in a period from when the primary current I1 is cut off by the IGBT 312 to when a determination time ends (S254: YES), the process proceeds to step S260 corresponding to step S160. When it is determined that the primary voltage V1 excluding the maximum peak occurring first does not become greater than the threshold value, in a period from when the primary current I1 is cut off by the IGBT 312 to when a determination time ends (S254: NO), the process proceeds to step S258.

At step S258, it is determined whether the above-described discharge period has ended. When it is determined that the discharge period has ended (S258: YES), the process proceeds to step S260 corresponding to step S160. When it is determined that the discharge period has not ended (S258: NO), the process proceeds to step S240.

In the other steps, the processes of steps S200, 210, 220 and 230 in FIG. 12 are the same as the processes of steps S100, 110, 120 and 130 in FIG. 9, respectively. Therefore, the process of step S200 corresponds to a process by the creeping discharge control unit. The process of step S240 corresponds to a process by the air discharge control unit.

Figure 13:
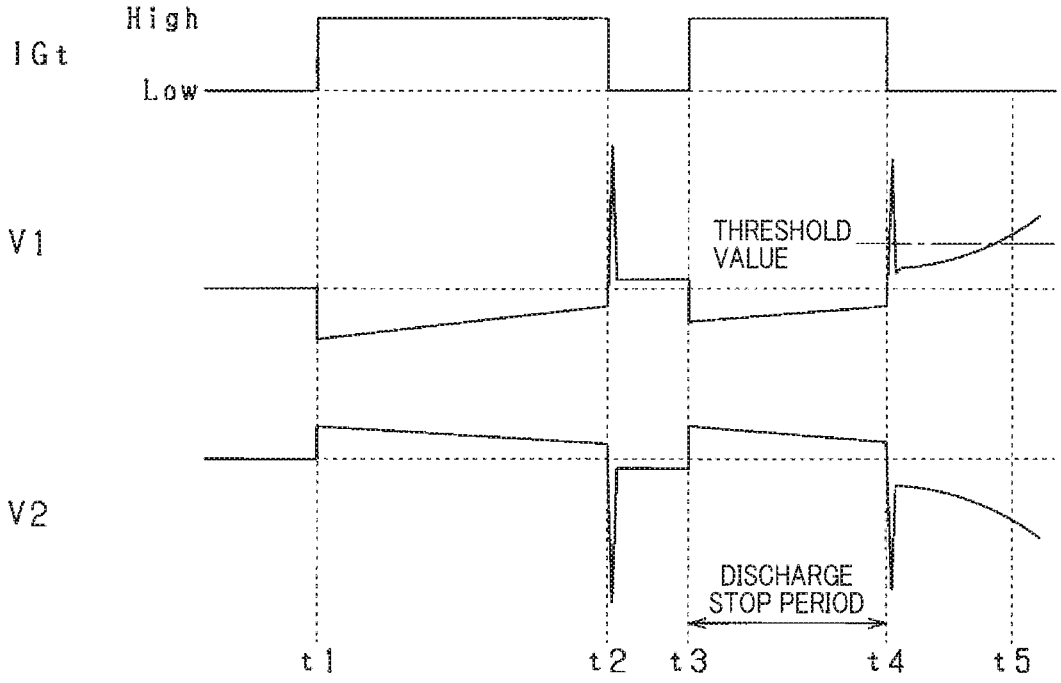
FIG. 13 is a time chart showing an operation of discharge control in accordance with the alternative example.

The following will describe an aspect of the discharge control according to the present alternative example with reference to FIG. 13.

In FIG. 13, IGt indicates whether the ignition signal IGt is outputted to the gate terminal of the IGBT 312, with high or low. V1 indicates a value of the primary voltage V1 applied to the primary coil 311A. V2 indicates a value of the secondary voltage V2 applied to the spark plug 19.

The electronic control unit 32 transmits the ignition signal IGt to the gate terminal of the IGBT 312 (see time t1). As a result, the IGBT 312 is closed. The primary current I1 supplies through the primary coil 311A. Then, after the first predetermined time ends, the output of the ignition signal IGt by the electronic control unit 32 to the gate terminal of the IGBT 312, is stopped (see time t2). As a result, the IGBT 312 is opened. The conduction of the primary current I1 supplying through the primary coil 311A is cut off and then the secondary voltage V2 is induced in the secondary coil 311B. At the time, it is assumed that the discharge occurring in the spark plug 19 is a creeping discharge, and therefore, the air discharge determination process is not performed in the period (see time t2-t3).

The output of the ignition signal IGt to the gate terminal of the IGBT 312 is resumed after the conduction of the primary current I1 supplying through the primary coil 311A is cut off by the IGBT 312 that is opened and then the second predetermined period ends (see time t3). As a result, the IGBT 312 is closed. The conduction of the primary current I1 through the primary coil 311A is performed, and the discharge occurring in the spark plug 19 is stopped. After the discharge stop period ends, the output of the ignition signal IGt to the gate terminal of the IGBT 312 is stopped, so that the IGBT 312 is opened, and the secondary voltage V2 is induced in the secondary coil 311B, and the discharge occurs again at the spark plug 19 (see time t4).

At the time, the air discharge determination process is performed that determines whether the primary voltage V1 excluding the maximum peak occurring first is greater than the threshold value, in a period from when the primary current I1 is cut off by the IGBT 312 to when a determination time ends (see time t4 to t5). In the example shown in FIG. 13, since the primary voltage V1 excluding the maximum peak occurring first becomes greater than the threshold value, in a period from when the primary current I1 is cut off by the IGBT 312 to when a determination time ends, the discharge occurring in the spark plug 19 is determined to be an air discharge occurring in the spark plug 19, and then the air discharge transition control is ended, and the IGBT 312 continues to be open. As a result, the air discharge is generated continuously.

Figure 14:
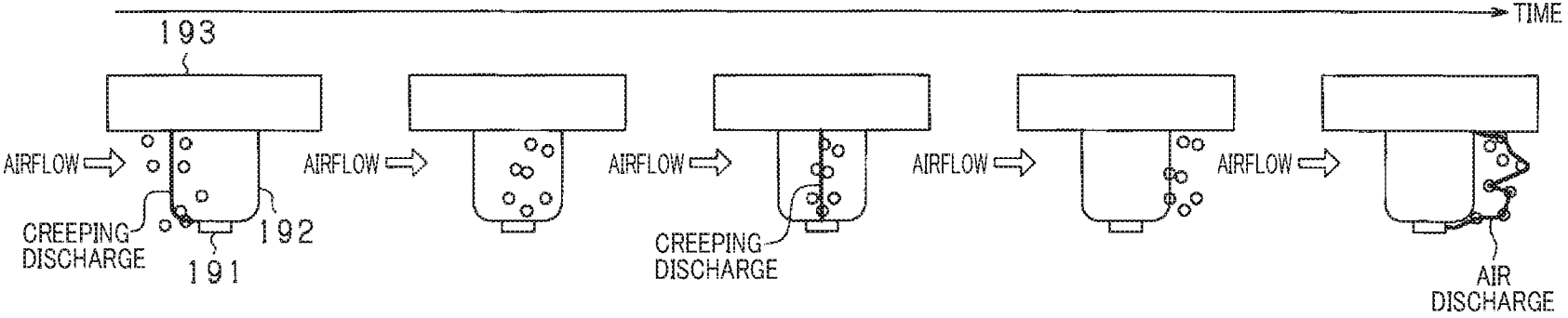
FIG. 14 is a schematic view of showing a case in which the air discharge transition control is repeatedly performed in a situation in which a creeping discharge occurs on an upstream side of the gas flowing in the combustion chamber.

For example, as shown in FIG. 14, it is assumed that a creeping discharge occurs upstream of airflow of gas flowing in the combustion chamber 11*b*. In the case, there is a possibility that the electric charges cannot be sufficiently separated from the insulator 192, so that the creeping discharge cannot be converted to an air discharge only by performing the air discharge transition control once. Therefore, in such a situation, the air discharge transition control is repeated. At the time, the electric charges flow downstream with the airflow, and the position where the creeping discharge is generated is also changed to the downstream side in accordance with the position of the flow of electric charges. Then, the electric charges are separated from the insulator 192. The discharge generated at the spark plug 19 becomes an air discharge. Thus, when a creeping discharge occurs on the upstream side of the gas flowing through the combustion chamber 11*b*, it is assumed that a certain time is needed to convert to an air discharge, compared to the case in which a creeping discharge occurs on the downstream side of the gas flowing through the combustion chamber 11*b*. Therefore, when the discharge control time is provided as in the above-described embodiment, there is a possibility that the creeping discharge cannot be converted to the air discharge in a period from when the air discharge transition control is performed to when the discharge control time ends.

In contrast, in the present alternative example, each time the air discharge transition control is performed, the air discharge determination process that determines whether the discharge generated by the spark plug 19 is an air discharge is performed. As a result, the air discharge transition control can be repeatedly performed until it is determined that an air discharge occurs. Therefore, in the ignition control system according to the present alternative example, it is possible to convert the creeping discharge generated by the spark plug 19 to the air discharge without depending on the flow direction of the gas.

The aspect of the discharge control in the above embodiment is included in the time chart in FIG. 13. More specifically, the content from which the air discharge determination process performed in the period between the time t4 to time t5 is omitted, is the aspect of the discharge control in the above embodiment.

The air discharge determination process performed in (1) is not required as a determination target because there is a high possibility that the discharge occurring in the spark plug 19 is a creeping discharge by performing the creeping discharge control. In this regard, the air discharge determination process may be performed as a determination target of the discharge occurring in the spark plug 19 by performing the creeping discharge control. In the case, the IGBT 312 may not be controlled to supply the primary current I1 through the primary coil 311A after the IGBT 312 is controlled to cut off the primary current I1 supplying through the primary coil 311A and then the second predetermined time ends. The control is performed based on the determination result of the air discharge determination process. Specifically, when it is determined that when the creeping discharge control is performed, the primary voltage V1 excluding the maximum peak occurring first does not become greater than the threshold value, in a period from when the primary current I1 is cut off by the IGBT 312 to when a determination time ends, the air discharge transition control is performed. On the other hand, when it is determined that when the creeping discharge control is performed, the primary voltage V1 excluding the maximum peak occurring first becomes greater than the threshold value, in a period from when the primary current I1 is cut off by the IGBT 312 to when a determination time ends, the air discharge transition control is not performed, and the IGBT 312 continues to be open.

In (1), the air discharge determination process is performed based on the primary voltage V1. In this regard, the air discharge determination process may be performed based on the secondary voltage V2 instead of the primary voltage V1. Specifically, the voltage detection circuit 314 is configured to detect the secondary voltage V2 applied to the secondary coil 311B. It may be determined that the discharge occurring in the spark plug 19 is an air discharge on condition that the absolute value of the secondary voltage V2 excluding the maximum peak occurring first becomes greater than the threshold value set to be greater than the secondary voltage V2 necessary to maintain the creeping discharge, in a period from when the primary current I1 is cut off by the IGBT 312 to when a determination time ends.

In the air discharge determination process described in (1), it is determined that the primary voltage V1 excluding the maximum peak occurring first becomes greater than the threshold value, in a period from when the primary current I1 is cut off by the IGBT 312 to when a determination time ends. In this regard, for example, it may be configured to determine that the amount of increase per unit time of the primary voltage V1 excluding the maximum peak occurring first continues to be greater than a predetermined amount, in a period from when the primary current I1 is cut off by the IGBT 312 to when a determination time ends.

The following describes another example applicable to the alternative example of (1). As the case in which it is determined that the discharge occurring in the spark plug 19 is not an air discharge, it is assumed that electric charges move to an outer side relative to the radial outer end of the ground electrode 193 other than when the electric charges are still present near the insulator 192. In the latter case, even if the air discharge transition control is repeatedly performed without changing the discharge stop period, the electric charges generated by the generation of the creeping discharge move to the outer side relative to the radial outer end of the ground electrode 193, so that there is a risk that the air discharge cannot be performed. To avoid this risk, the discharge stop period may be set shorter than the current discharge stop period, on condition that it is determined that the discharge occurring in the spark plug 19 is not an air discharge.

Figure 15:
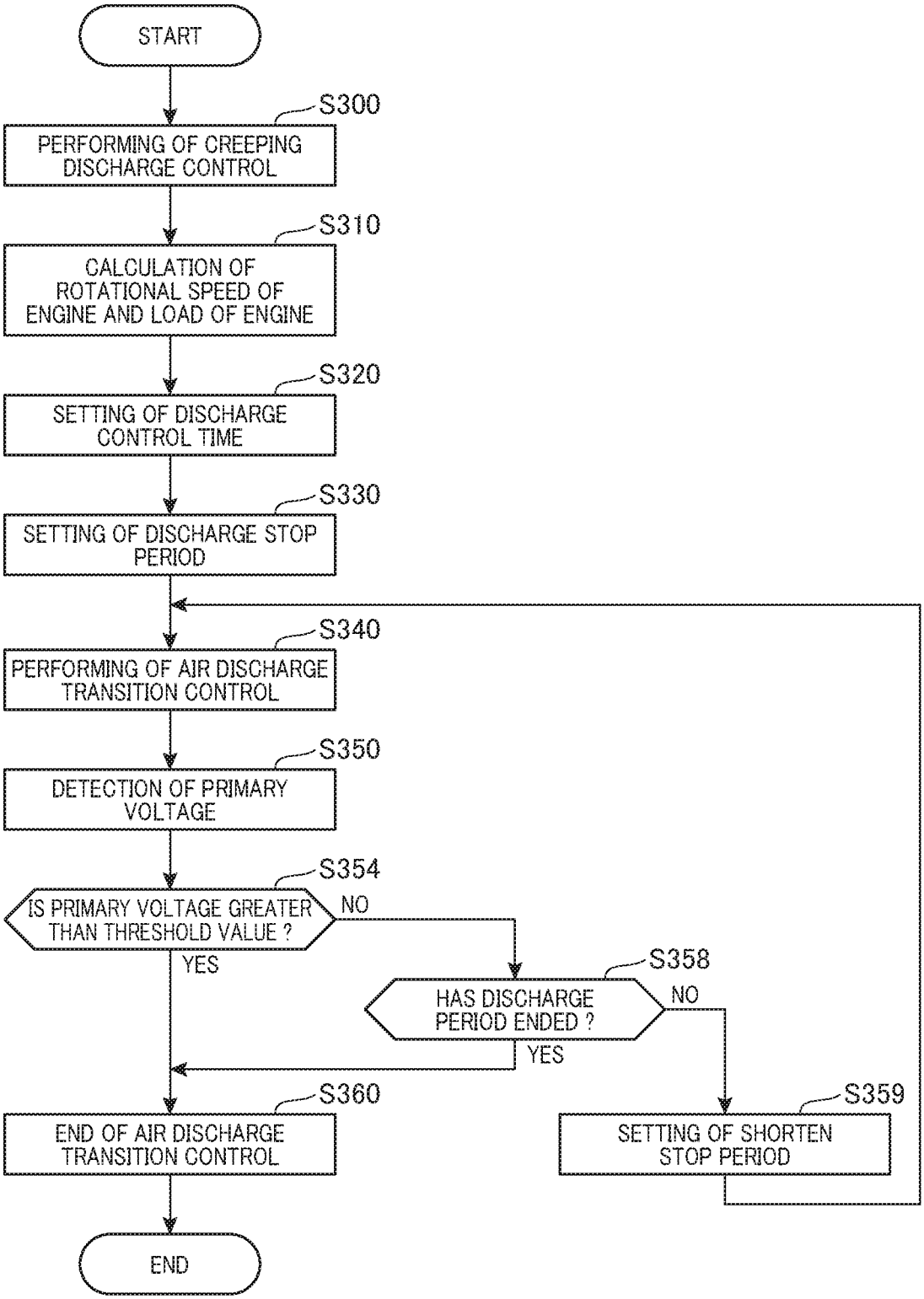
FIG. 15 is a control flowchart executed by the electronic control unit according to the alternative example.

FIG. 15 is a modification of a part of the flowchart of FIG. 12. That is, step S359 is newly added as a step to be performed when NO is determined in the determination process of step S358 corresponding to step S258 in FIG. 12.

At step S359, the discharge stop period set in step S330 corresponding to step S230 is set again to the discharge stop period shortened by the correction period, and the process returns to step S340 corresponding to step S240.

In the other steps, the processes of steps S300, 310, 320, 350, 354, and 360 in FIG. 15 are the same as the processes of steps S200, 210, 220, 250, 254, and 260 in FIG. 12, respectively. Therefore, the process of step S300 corresponds to a process by the creeping discharge control unit, and the process of step S340 corresponds to a process by the air discharge control unit.

Thus, the primary current I1 supplying through the primary coil 311A can be cut off before the electric charges generated by the occurrence of the creeping discharge reach the radial outer end of the ground electrode 193, so that the probability of occurrence of the air discharge can be improved.

Although the present disclosure has been described based on the embodiment, it is understood that the present disclosure is not limited to the embodiment and structure. The present disclosure also includes various modifications and variations within the equivalent range. In addition, various combinations and forms, and also other combinations and forms including only one element, or more, or less are within the category and the thought scope of the present disclosure.

What is claimed is:

1. An ignition control system comprising:

a spark plug mounted in an engine, including a cylindrical ground electrode, a cylindrical insulator having a protruding portion held inside the ground electrode and protruding toward a tip side the spark plug relative to the ground electrode, and a center electrode held inside the insulator and exposed from the insulator;

an ignition coil including a primary coil and a secondary coil, and applying a secondary voltage to the spark plug using the secondary coil; and a primary current control unit performing creeping discharge control for generating a creeping discharge along a surface of the insulator by cutting off primary current after the primary current supplies through the spark plug, and air discharge transition control for stopping the creeping discharge occurring in the spark plug by supplying the primary current through the primary coil after the creeping discharge control is performed, and cutting off the primary current in one combustion cycle of the engine after a discharge stop period as a time required for transition to an air discharge in which a discharge occurs at a position away from the insulator, ends.

2. The ignition control system according to claim 1, wherein the discharge stop period is variably set in accordance with an operating state of the engine.

3. The ignition control system according to claim 1, wherein the discharge stop period is set based on a map in which the discharge stop period is determined based on the operating state of the engine.

4. The ignition control system according to claim 1, wherein the discharge stop period is set shorter as load of the engine is higher or as a rotational speed of the engine is higher.

5. The ignition control system according to claim 1, further comprising:

a flow rate detection unit that detects a flow rate of gas flowing in a combustion chamber of the engine, wherein the discharge stop period is variably set in accordance with the flow rate detected by the flow rate detection unit.

6. The ignition control system according to claim 5, wherein the discharge stop period is set shorter as the flow rate of the gas detected by the flow rate detection unit is higher.

7. The ignition control system according to claim 1, wherein the discharge stop period is set within a range from a time when electric charges, generated by generation of the creeping discharge in the spark plug, reach a radial inner end of the ground electrode to a time when the electric charges reach a radial outer end of the ground electrode.

8. The ignition control system according to claim 1, further comprising:

a flow rate detection unit that detects a flow rate of gas flowing in a combustion chamber of the engine, wherein the discharge stop period is set within a range from a first value to a second value, the first value being a value obtained by a calculation in which a difference obtained by subtracting a diameter of the insulator from an inner diameter of the ground electrode, is divided by the flow rate detected by the flow rate detection sensor, the second value being a value obtained by a calculation in which a difference obtained by subtracting the diameter of the insulator from an outer diameter of the ground electrode, is divided by the flow rate detected by the flow rate detection unit.

9. The ignition control system according to claim 1, further comprising:

an air discharge determination unit that determines whether a discharge occurring in the spark plug is an air discharge in which the discharge occurs at a position away from a surface of the insulator, wherein the primary current control unit repeatedly performs the air discharge transition control until the air discharge determination unit determines that the discharge occurring in the spark plug is the air discharge, and wherein when the air discharge determination unit determines that the discharge occurring in the spark plug is the air discharge, the air discharge transition control unit ends the air discharge transition control and controls to cut off the primary current.

10. The ignition control system according to claim 9, wherein the discharge stop period is set shorter than a present discharge stop period on condition that the discharge occurring in the spark plug is determined not to be the air discharge by the air discharge determination unit.

11. The ignition control system according to claim 9, further comprising:

a voltage value detection unit that detects a voltage value of at least one of a primary voltage applied to the primary coil and a secondary voltage applied to the spark plug, wherein the air discharge determination unit determines that the discharge occurring in the spark plug is the air discharge on condition that an absolute value of the voltage value after a maximum peak occurring first by a cutting off the primary current, controlled by the primary current control unit, becomes greater than a threshold value that is set greater than an absolute value of the voltage value necessary to maintain the creeping discharge.

12. An ignition control apparatus applied to an engine comprising:

a spark plug including a cylindrical ground electrode, a cylindrical insulator having a protruding portion held inside the ground electrode and protruding toward a tip side the spark plug relative to the ground electrode, and a center electrode held inside the insulator and exposed from the insulator; and an ignition coil including a primary coil and a secondary coil, and applying a secondary voltage to the spark plug using the secondary coil, wherein the ignition control apparatus includes a primary current control unit performing, in one combustion cycle of the engine, creeping discharge control for generating a creeping discharge along a surface of the insulator by cutting off primary current performed after supplying the primary current through the spark plug, and air discharge transition control for stopping the creeping discharge occurring in the spark plug by supplying the primary current through the primary coil after the creeping discharge control is performed, and for cutting off the primary current after a discharge stop period as a time required for transferring to an air discharge in which a discharge occurs at a position away from the insulator, ends.

* * * * *